US006719171B1

(12) United States Patent
Bitton

(10) Patent No.: US 6,719,171 B1
(45) Date of Patent: Apr. 13, 2004

(54) WIRE FRAME MOUNTING STRUCTURE FOR ORNAMENTS WITHIN A CONTAINER

(75) Inventor: Mary Kay Bitton, 467 Burano Ct., Oak Park, CA (US) 91377

(73) Assignee: Mary Kay Bitton, Westlake Village, CA (US)

( * ) Notice: Subject to any disclaimer, the term of this patent is extended or adjusted under 35 U.S.C. 154(b) by 32 days.

(21) Appl. No.: 09/998,744

(22) Filed: Nov. 30, 2001

(51) Int. Cl.[7] ..... B67D 5/60
(52) U.S. Cl. ..... 222/78; 222/404.1; D07/300.2
(58) Field of Search ..... 222/78, 464.1; D9/434, 300, 318; D7/300.2

(56) References Cited

U.S. PATENT DOCUMENTS

| | | | | |
|---|---|---|---|---|
| 1,916,646 | A | 7/1933 | Tyco | |
| 3,134,505 | A | 5/1964 | Modderno | 222/82 |
| D334,503 | S | 4/1993 | Neubert | D7/300.2 |
| D392,148 | S | 3/1998 | Lewis | D7/300.2 |
| 5,915,600 | A | 6/1999 | Bitton | 222/464.1 |

*Primary Examiner*—Philippe Derakshani
(74) *Attorney, Agent, or Firm*—Susan L. Crockett, Esq.; Crockett & Crockett

(57) ABSTRACT

A pump, spray or suction actuated dispenser with a suction tube extending into a container, wherein the suction tube is used to mount a helix, and the helix carries at least one ornamental figure.

9 Claims, 4 Drawing Sheets

WIRE FRAME MOUNTING STRUCTURE FOR ORNAMENTS WITHIN A CONTAINER

FIELD OF THE INVENTION

This invention relates to devices for mounting structures and ornaments within containers.

BACKGROUND OF THE INVENTION

Bottles and jars are made with various ornamental features. The ornaments usually consist of the shape of the bottle, and artwork applied to the surface of the bottle. Liquid soap is now sold in clear plastic bottles with artwork on plastic sheets within the bottles.

SUMMARY

The devices described below provide a fluid dispenser comprising a container, a suction tube, a dispensing tip, and a pump mechanism. The container is made-up of a transparent material such that the suction tube can be seen. The suction tube is disposed within the container and the pump mechanism is secured to the container. The pump mechanism is in fluid communication with the suction tube. Attached to the suction tube is a substantially helical coil and attached to the coil are ornamental figures.

The ornamental figures may also be attached directly to the suction tube itself using some type of retaining means. Further, the helical coil need not be helical, it could be any type of wire frame structure that can be mounted onto the suction tube.

DETAILED DESCRIPTION OF THE INVENTION

Figure 1:
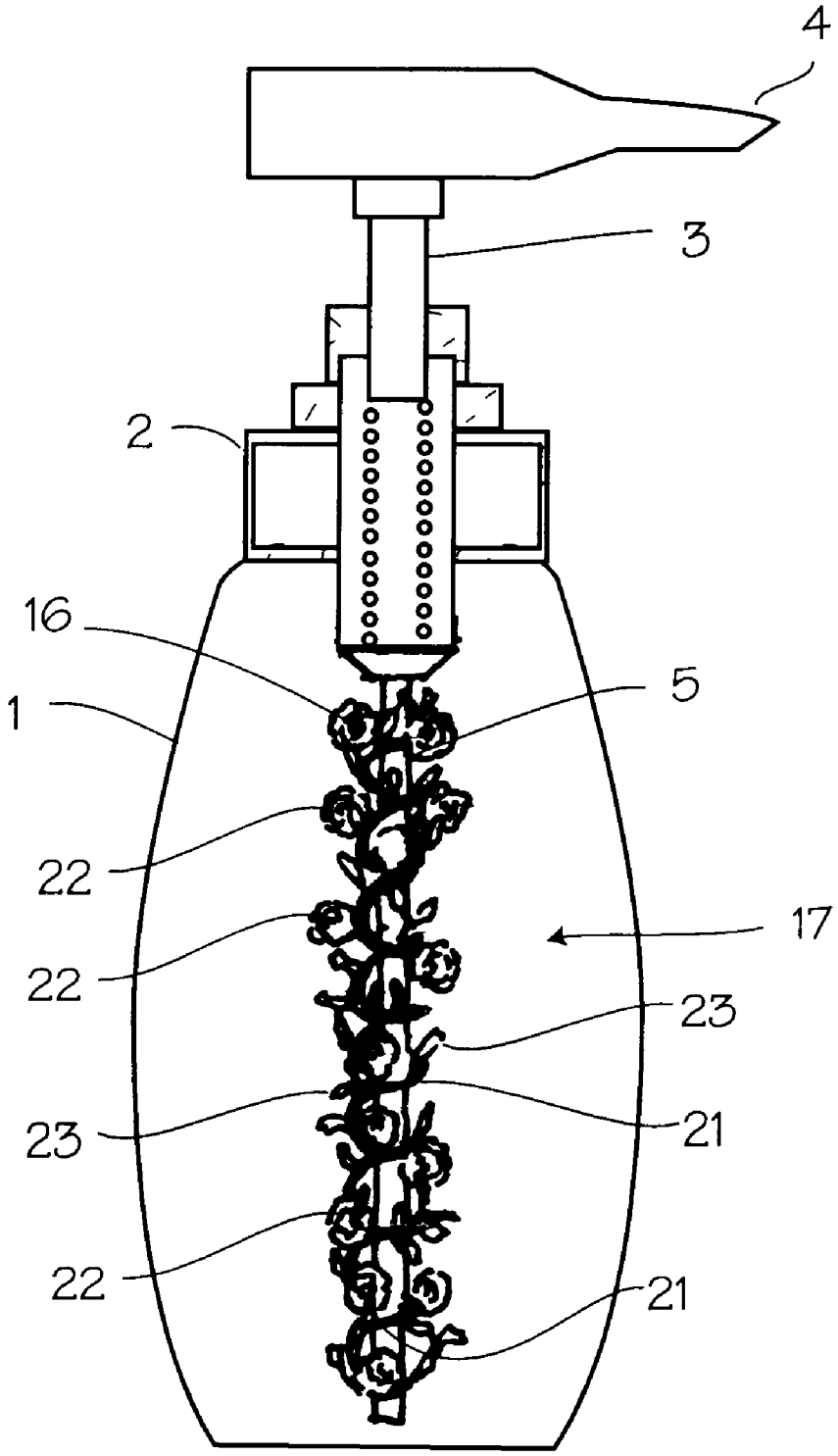
FIG. 1 is a front view of a pump dispenser having a helical coil attached to the suction tube and ornamental figures attached to the helical coil.

FIG. 1 shows a front view of a bottle with a pump dispenser typical of those used for liquid soaps. The bottle 1 is provided with a cap 2, a pump piston 3 and a dispensing tip 4. The suction tube 5 is connected to the pump piston and dispensing tip in any suitable manner known in the art. The suction tube 5 typically extends downward to the bottom of the bottle, and may be extra long so that it must bend to fit into the bottle. The suction tube is universally provided as a round or cylindrical tube, although it might have many different cross-sections. The dispensing tip may be a dropper dispenser for use with viscous materials such as liquid soap or Softsoap®, or it may be a spray dispenser for free flowing liquids such as perfume, hair spray, window cleaner, or it may be a sipping tube for beverages (in which case an intermediate pump mechanism is not used).

The ornamental assembly in FIG. 1 comprises a helical coil 21 with ornamental figures attached to the helical coil. The ornamental figures may be made in any form, representing any character, animal, thing, shape, flowers, leaves, beads, pearls, letters, numbers, or the like. In this case, the ornamental figures include flowers 22 and leaves 23 attached to a substantially helical coil wound around the suction tube. The helical coil, in combination with the flowers and leaves, form the ornamental assembly, which looks like a vine winding its way up the suction tube. The ornamental figures can also be slidably mounted on the helical coil by insertion of the helical coil into a receiving bore of the ornamental figure. In FIG. 1 the turns of the helical coil are spaced apart, although in other embodiments the turns can be touching. In alternative embodiments the ornamental assembly may consist solely of a helix wound around the suction tube.

The ornamental assembly is fabricated in any suitable manner. As can be seen in FIG. 1, the ornamental assembly is attached to the suction tube 5. To accomplish this attachment, the helical coil of the ornamental assembly is wound around the suction tube. The helical coil may be formed of resilient material such that the coil clings to the suction tube. If the helical coil is not resilient, then the coil may be attached to the suction tube with adhesive or by boring a hole into the suction tube and inserting at least one end of the helical coil through the hole.

Figure 2:
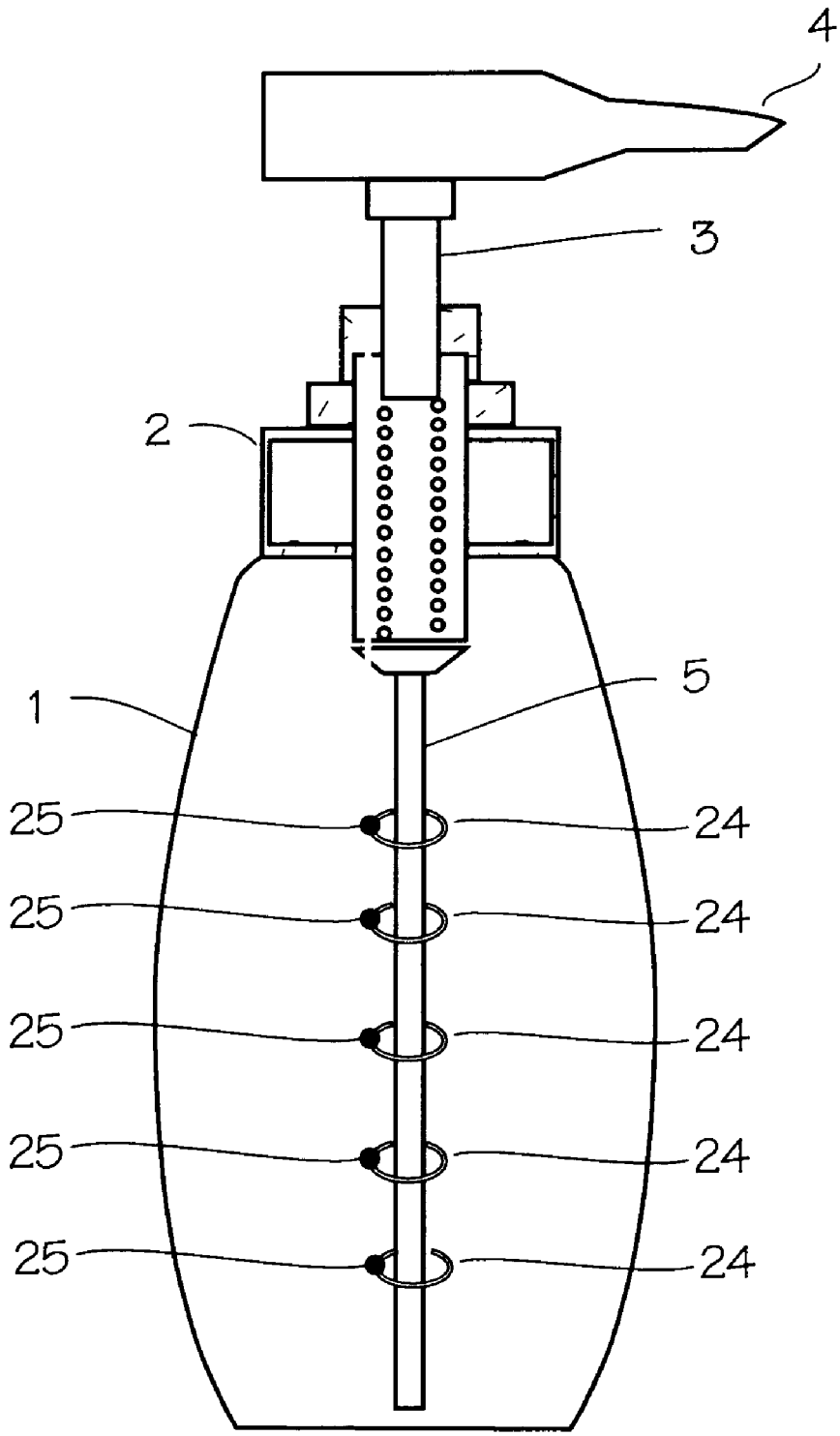
FIG. 2 is a front view of a pump dispenser having wire hoops attached to the suction tube and ornamental figures attached to the wire hoops.

FIG. 2 shows a front view of a bottle with a pump dispenser typical of those used for liquid soaps. The bottle 1 is provided with a cap 2, a pump piston 3 and a dispensing tip 4. The suction tube 5 is connected to the pump piston and dispensing tip in any suitable manner known in the art. The suction tube 5 typically extends downward to the bottom of the bottle, and may be extra long so that it must bend to fit into the bottle. The suction tube is universally provided as a round or cylindrical tube, although it might have many different cross-sections. The dispensing tip may be a dropper dispenser for use with viscous materials such as liquid soap or Softsoap®, or it may be a spray dispenser for free flowing liquids such as perfume, hair spray, window cleaner, or it may be a sipping tube for beverages (in which case an intermediate pump mechanism is not used).

The ornamental assembly shown in FIG. 2 comprises hoops 24 wrapped around the suction tube 5 and ornaments 25 attached to the hoops. Each hoop may be comprised of metal, plastic, elastomers or any other suitable material. In this case the ornaments shown are beads attached to a plurality of wire hoops wrapped around the suction tube. The ornaments may also be slidably mounted on the hoop. In alternative embodiments the ornamental assembly may consist solely of a hoop or a plurality of hoops.

Figure 3:
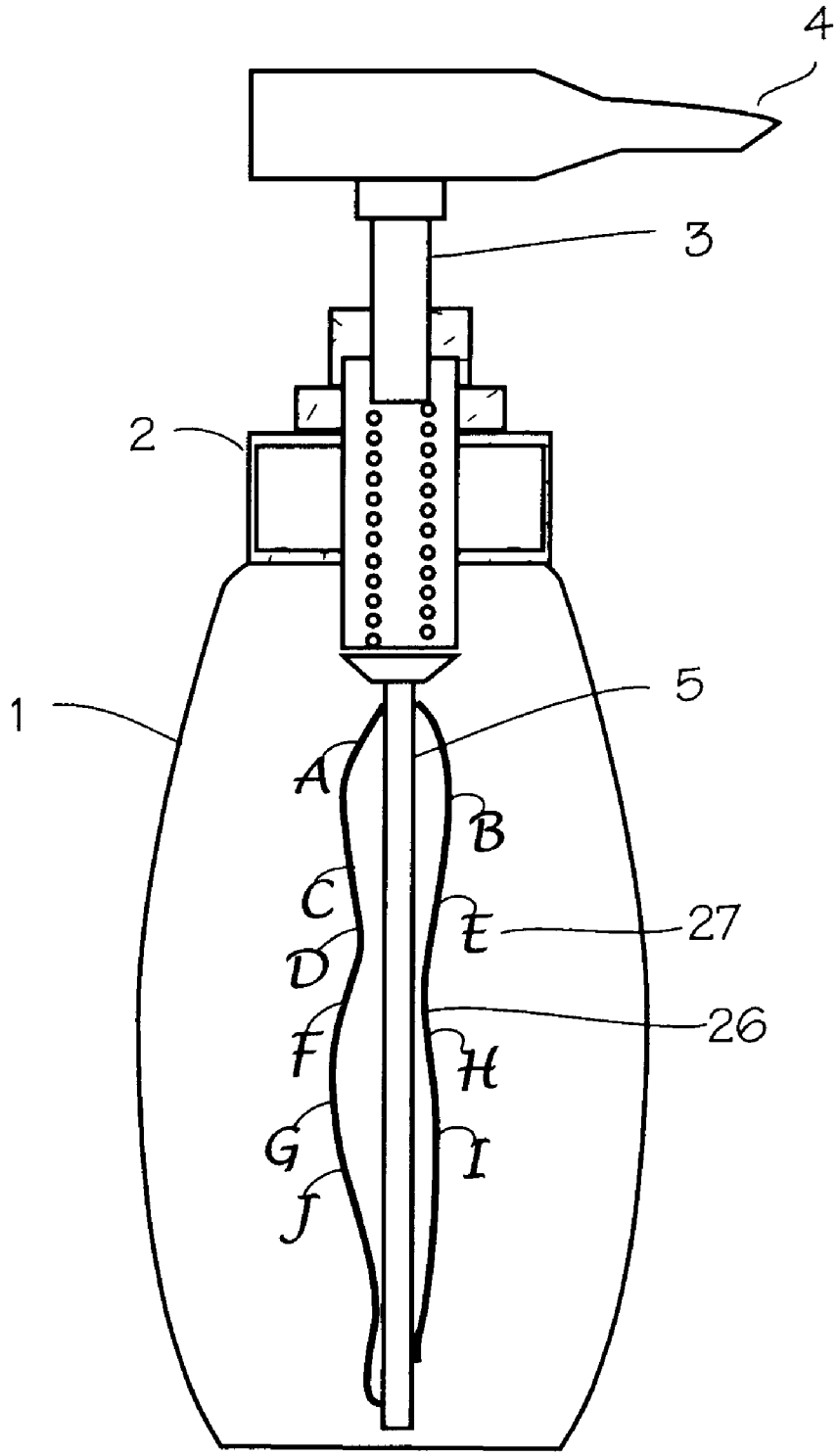
FIG. 3 is a front view of a pump dispenser having a wire frame structure attached to the suction tube and ornamental figures attached to the wire frame structure.

FIG. 3 shows a front view of a pump dispenser having a wire frame structure attached to the suction tube and ornamental figures attached to the wire frame structure. As in the previous figures, the bottle 1 is provided with a cap 2, a pump piston 3 and a dispensing tip 4; suction tube 5 is connected to the pump piston and dispensing tip in any suitable manner known in the art. The suction tube 5 typically extends downward to the bottom of the bottle, and may be extra long so that it must bend to fit into the bottle. The suction tube is universally provided as a round or cylindrical tube, although it might have many different cross-sections. The dispensing tip may be a dropper dispenser for use with viscous materials such as liquid soap or Softsoap®, or it may be a spray dispenser for free flowing liquids such as perfume, hair spray, window cleaner, or it may be a sipping tube for beverages (in which case an intermediate pump mechanism is not used).

The ornamental assembly shown in FIG. 3 comprises a wire frame structure 26 attached to the suction tube 5 and ornaments 27 attached to the wire frame structure. The wire frame structure may be comprised of metal, plastic or other suitable material. In this case, the ornaments shown are letters.

Figure 4:
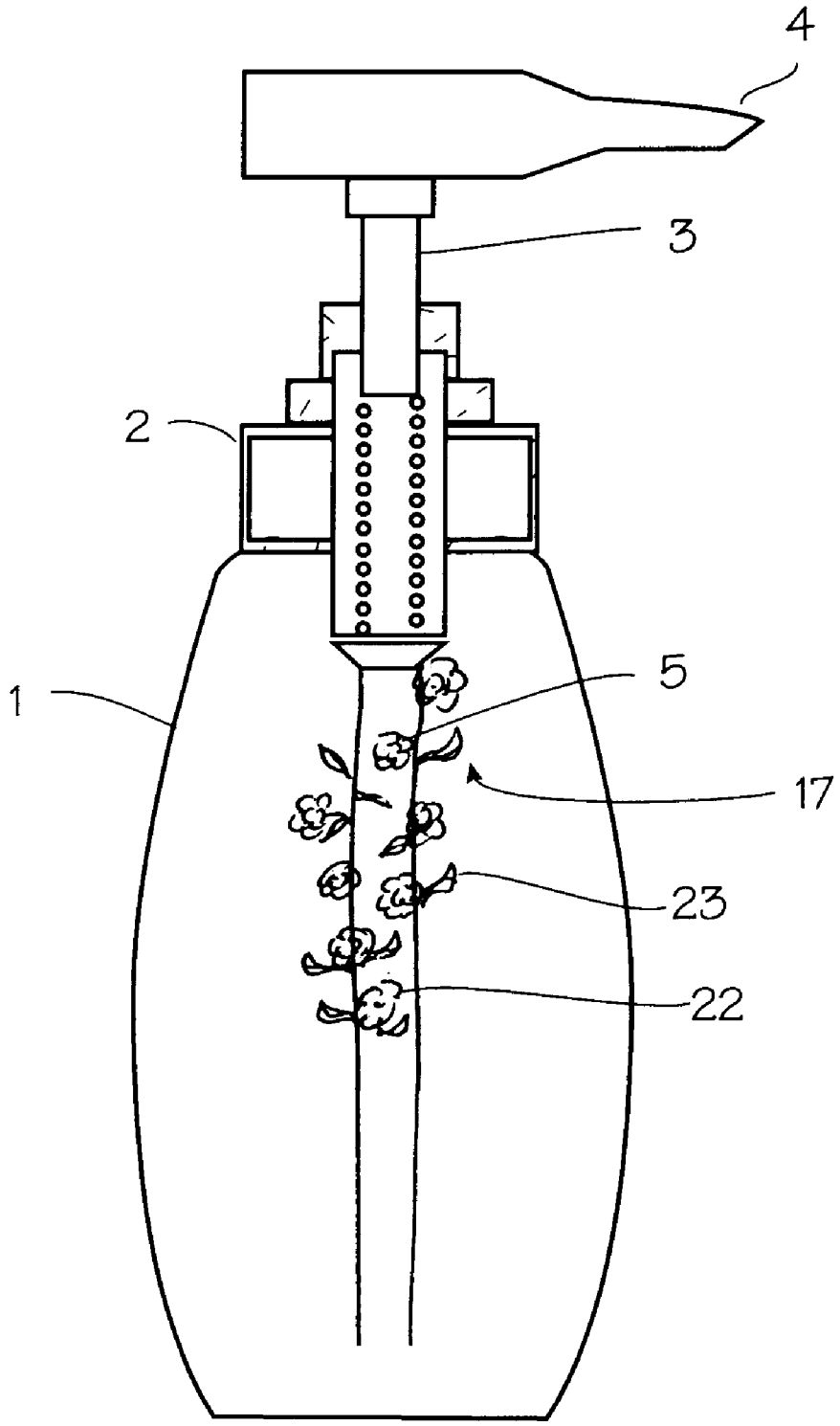
FIG. 4 is a front view of a pump dispenser having ornamental figures attached directly to the suction tube.

FIG. 4 shows a front view of a bottle with a pump dispenser typical of those used for liquid soaps. The bottle 1 is provided with a cap 2, a pump piston 3 and a dispensing tip 4. The suction tube 5 is connected to the pump piston and dispensing tip in any suitable manner known in the art. The suction tube 5 typically extends downward to the bottom of the bottle, and may be extra long so that it must bend to fit into the bottle. The suction tube is universally provided as a round or cylindrical tube, although it might have many different cross-sections. The dispensing tip may be a dropper dispenser for use with viscous materials such as liquid soap or Softsoap®, or it may be a spray dispenser for free flowing liquids such as perfume, hair spray, window cleaner, or it may be a sipping tube for beverages (in which case an intermediate pump mechanism is not used).

The ornamental assembly shown in FIG. 4 comprises at least one ornament 17 and means for retaining the ornament onto the suction tube. The means for retaining may include adhesive, staples, pins, or any other suitable means for retaining the ornaments onto the suction tube. In FIG. 4, the ornaments comprise numerous flowers 22 and leaves 23 attached directly to the suction tube 5. They may, however, comprise any other form of ornament.

The ornamental assembly may be placed inside the container either before or during manufacture. Where the assembly is smaller than the container neck, it may simply be loaded onto the suction tube and inserted into the bottle when the cap and pump assembly is screwed onto the bottleneck. Assemblies larger than the bottleneck may be installed inside the bottle during manufacture of the bottle.

The suction tube mounted ornaments may be used in sipper cups, soap dispensers, bubble bath dispensers, shampoo bottles, toothpaste pumps, sport bottles, perfume bottles, and bottles, jars, cups and containers of all descriptions. The ornaments may comprise artistic representations of many figures and characters, including action figures, sports figures, cartoon characters, children's characters (Sesame Street characters, Barney, fairy tale characters), seasonal characters and many more.

While the preferred embodiments of the devices and methods have been described in reference to the environment in which they were developed, they are merely illustrative of the principles of the inventions. Other embodiments and configurations may be devised without departing from the spirit of the inventions and the scope of the appended claims.

I claim:

1. A fluid dispenser comprising a container, a suction tube, a dispensing tip, and a pump mechanism, said container being comprised of a transparent material, said suction tube being disposed within the container, said pump mechanism secured to the container, said pump mechanism being in fluid communication with the suction tube, said fluid dispenser further comprising:

a substantially helical coil attached to the suction tube;

ornamental figures attached to the substantially helical coil; and wherein the ornamental figures are comprised of flowers and leaves.

2. The fluid dispenser of claim 1 wherein the substantially helical coil comprises a resilient material.

3. A fluid dispenser comprising a container, a suction tube and a dispensing tip, further comprising:

a pump mechanism secured to the container, said pump mechanism being in fluid communication with the suction tube;

said suction tube being disposed within the container; said container being comprised of a transparent material;

a helix helically wound around the suction tube, said helix comprising a wire wound in a plurality of turns; and at least one ornament within the container, said ornament secured to the helix.

4. The device of claim 3 wherein the ornament has a receiving bore sized and dimensioned to receive the wire within the receiving bore, and said ornament being slidably mounted on the wire by insertion of the wire into the receiving bore.

5. The device of claim 3 wherein the ornament comprises three-dimensional representations of a flower.

6. The device of claim 3 further comprising a plurality of ornaments comprising three-dimensional representations of flowers, wherein said ornaments are distributed along the length of the helix.

7. The device of claim 3 further comprising a plurality of ornaments comprising three-dimensional representations of leaves, wherein said ornaments are distributed along the length of the helix.

8. A fluid dispenser comprising a container, a suction tube, a dispensing tip, and a pump mechanism, said container being comprised of a transparent material, said suction tube being disposed within the container, said pump mechanism secured to the container, said pump mechanism being in fluid communication with the suction tube, said fluid dispenser further comprising:

a wire attached to the suction tube; and at lease one ornamental figure attached to the wire.

9. A fluid dispenser comprising a container, a suction tube, a dispensing tip, and a pump mechanism, said container being comprised of a transparent material, said suction tube being disposed within the container, said pump mechanism secured to the container, said pump mechanism being in fluid communication with the suction tube, said fluid dispenser further comprising:

ornamental figures; and wire means for retaining the ornamental figures on the suction tube.

* * * * *